US006325681B1

(12) United States Patent
Doi

(10) Patent No.: US 6,325,681 B1
(45) Date of Patent: Dec. 4, 2001

(54) CABLE CONNECTOR AND CONTACTS FOR CABLE CONNECTOR

(75) Inventor: Etsuro Doi, Tokyo (JP)

(73) Assignee: Kel Corporation, Tokyo (JP)

( * ) Notice: Subject to any disclaimer, the term of this patent is extended or adjusted under 35 U.S.C. 154(b) by 0 days.

(21) Appl. No.: 09/638,158

(22) Filed: Aug. 14, 2000

(30) Foreign Application Priority Data

Aug. 19, 1999 (JP) ..... 11-233217

(51) Int. Cl.[7] ..... H01R 13/11
(52) U.S. Cl. ..... 439/857; 439/495
(58) Field of Search ..... 439/494, 495, 439/499, 857

(56) References Cited

U.S. PATENT DOCUMENTS 5,334,053 * 8/1994 Noschese ..... 439/682
6,004,156 * 12/1999 Roque et al. ..... 439/495

FOREIGN PATENT DOCUMENTS

1392205 * 2/1965 (FR) ..... 439/495

* cited by examiner

*Primary Examiner*—Khiem Nguyen
(74) *Attorney, Agent, or Firm*—Robert W. J. Usher

(57) ABSTRACT

An electrical cable connector comprises a plurality of female contacts 20 and a plurality of cables 50. The female contacts 20 are aligned and retained in a row extending in a right and left direction in an insulative housing 10, and one end of each cable is connected to a corresponding female contact in the insulative housing 10. Each of the female contacts comprises a base portion 21, which is fixed in the insulative housing 10 and to which the core wire of a corresponding cable 50 is connected, and a resilient arm portion 25, which is continuous from the base portion 21 and extends along the base portion 21 with a predetermined distance therebetween. When this connector is engaged with a matable connector, each female contact receives and holds a corresponding male contact of the matable connector in a space between the base portion 21 and the resilient arm portion 25, thus establishing the electrical connection of the female and male contacts.

9 Claims, 8 Drawing Sheets

CABLE CONNECTOR AND CONTACTS FOR CABLE CONNECTOR

FIELD OF THE INVENTION

The present invention relates to an electrical cable connector which includes a plurality of electrical contacts aligned in a row extending in a right and left direction in an electrically insulative housing and a plurality of cables connected to and extending from the contacts through the insulative housing outward. The present invention also relates to electrical contacts which can be used in such cable connectors.

BACKGROUND OF THE INVENTION

FIG. 12 shows a prior-art cable connector. This cable connector 90 includes a plurality of female contacts 93, each of which is shaped like a tuning fork, in an electrically insulative housing 91. The female contacts 93 are press-fit into the housing 91, with the longitudinally central portion 93*d* (referred to as "fixed portion") of each female contact being retained and fixed in the housing 91, and in a crimping portion 93*c* which is provided at the rear end (or leg portion) of each female contact, the core wire 95*a* of a corresponding shielded cable 95 is crimped. In this condition, the shielded cables 95 extend outward through a cover 92, which is provided at the rear of the housing 91. The forwardly extending fork portion of each female contact 93 comprises a pair of resilient arms 93*a* and 93*b*, which can undergo outward elastic deformation in the space provided between the outer edges of the resilient arms 93*a* and 93*b* and the internal walls of the housing 91.

Another connector 96, which is matable with this cable connector 90, comprises a plurality of male contacts 98 aligned in a row in an electrically insulative housing 97 as shown in the figure. When this matable connector 96 is fitted to the cable connector 90 as shown by arrow A in the figure, the male contacts 98 come through the front opening 91*a* of the cable connector 90 into the internal cavity of the housing 91, where the female contacts 93 are positioned. In this insertion, each male contact 98 entering the space between the resilient arms 93*a* and 93*b* of a corresponding female contact 93 deforms these arms elastically outwardly, creating resiliency therein, and the resulting resilient forces act to retain the male contact 98 in the female contact 93 firmly for a secure electrical connection.

In this construction of the cable connector, it is important to make the resilient arms 93*a* and 93*b* long enough to acquire a sufficient resiliency for the firm connection of the male and female contacts only from the elastic deformation caused by the insertion of the male contact 98. In addition, the female contact 93 must include the fixed portion 93*d*, which is used for fixing the female contact 93 to the housing 91, and the crimping portion 93*c*, which is used for connecting the female contact 93 to the core wire 95*a* of a shielded cable 95, as mentioned above. As a result, the female contact 93 tends to be lengthened in design and may present a problem of the cable connector 90 being elongated and enlarged in construction.

SUMMARY OF THE INVENTION

It is an object of the present invention to provide an electrical cable connector whose resilient arms can receive and retain male contacts firmly and which can be connected to the core wires of cables.

It is another object of the present invention to provide an electrical cable connector whose construction is compact with a relatively short longitudinal dimension and a relatively small size.

It is yet another object of the present invention to provide an electrical contact which is used in such cable connectors.

To achieve these objectives, an electrical cable connector according to the present invention comprises a plurality of contacts and a plurality of cables. The contacts are aligned and retained in a row extending in a right and left direction in an electrically insulative housing, and each of the cables is connected at one end thereof to a corresponding contact in the insulative housing and extends out of the insulative housing. Each contact comprises a base portion and a resilient arm portion. The base portion is fixed in the insulative housing and connected to the one end of a corresponding cable, and the resilient arm portion is formed continuously from the base portion and extends along the base portion, keeping a predetermined distance therebetween. When the cable connector is engaged with a matable connector, each contact of the cable connector receives and holds a corresponding contact portion of the matable connector in a space between the base portion and the resilient arm portion, so that the contacts of the cable connector and the matable connector are connected electrically. With this design, in which one end of each of the cables is connected to the base portion of a corresponding contact, the length of the contacts is relatively short. As a result, the cable connector is made relatively small and compact.

It is preferable that the contact be formed in a figure of tuning fork with a short leg portion or without any leg portion. In this case, one prong constitutes the base portion while the other prong constitutes the resilient arm portion. For the connection of one end of each cable to the base portion of a corresponding contact, soldering, crimping or pressure-welding can be applied.

A contact used for an electrical cable connector according to the present invention is formed in a figure of tuning fork with a short leg portion or without any leg portion. In this case, one prong functions as a base portion which is fixed in an electrically insulative housing and at which the contact is connected to one end of a corresponding cable. The other prong functions as a resilient arm portion which is deformable elastically with respect to the base portion. This contact can receive a matable contact in a space between the base portion and the resilient arm portion and hold it by a resiliency generated from the elastic deformation of the resilient arm portion. In this design of the contact, one prong of the fork accommodating the matable contact functions as the base portion, to which a cable is connected. Therefore, the contact is made relatively short and compact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE PREFERRED EMBODIMENTS

Figure 1:
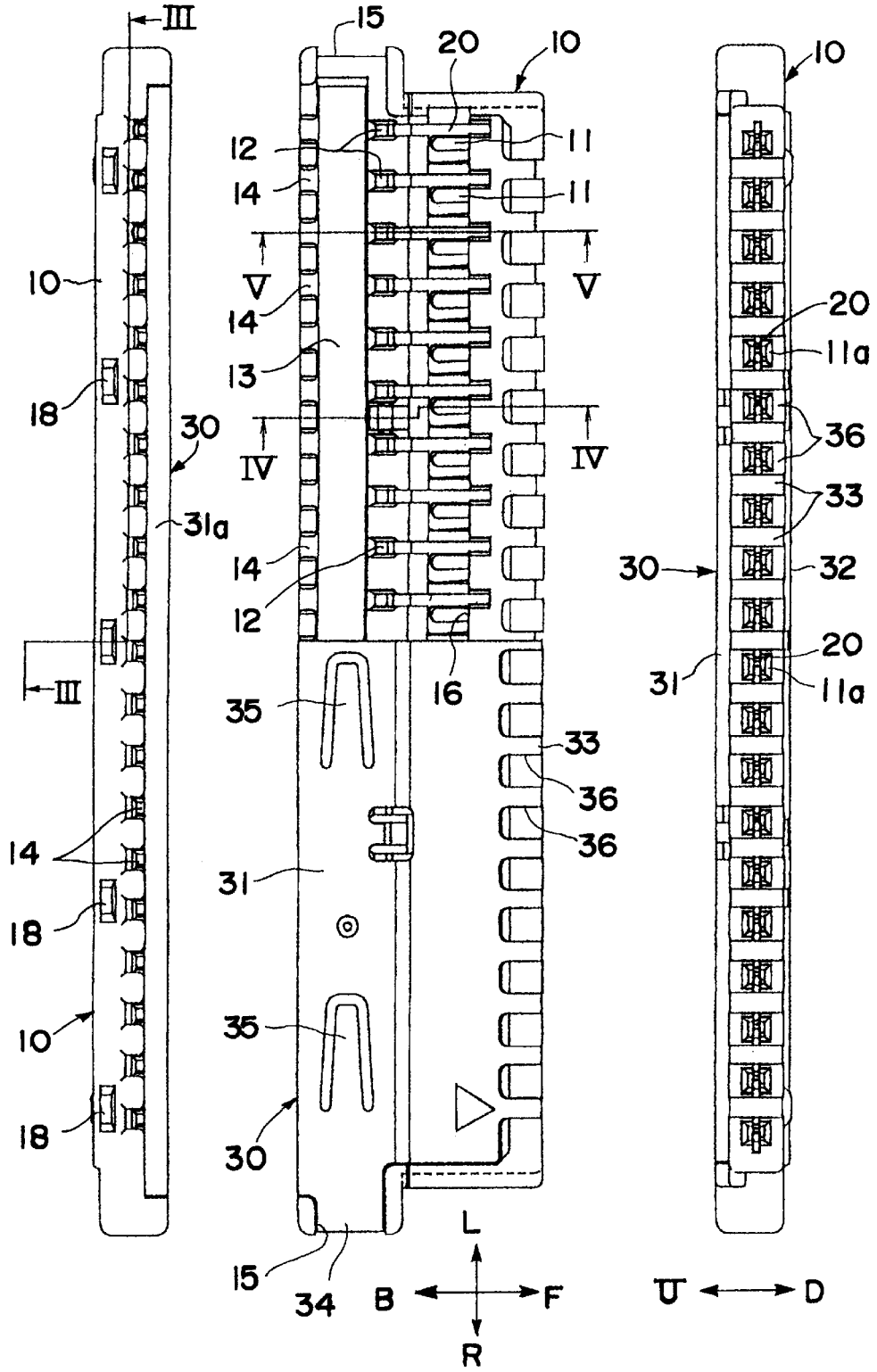
FIGS. 1A, 1B 1C, respectively, show a rear view, a plan view and a front view of an electrical cable connector according to the present invention.
Figure 2:
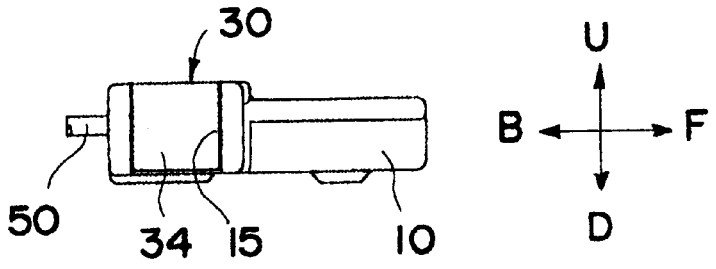
FIG. 2 is a side view of the cable connector.

FIGS. 1 and 2 show an embodiment of electrical cable connector according to the present invention. This cable connector comprises a plurality of female contacts 20, a housing 10 made of an electrically insulative material, and a shield cover 30. The female contacts 20 are aligned in a row in the direction of the width of the cable connector (the vertical direction of the drawing in FIG. 1), and the shield cover 30 is provided to cover the insulative housing 10. For ease of description, the right side of the drawing shown in FIG. 1B is referred to as the front side of the cable connector while the left side of the drawing is referred to as the rear side of the connector. Likewise, the upper side of the drawing shown in FIG. 1B is referred to as the left side of the cable connector while the lower side of the drawing is referred to as the right side of the connector. Furthermore, the right side of the drawing shown in FIG. 1C is referred to as the lower side of the cable connector while the left side of the drawing is referred to as the upper side of the connector.

To show the internal configuration of the housing 10, the left half of the shield cover 30 is taken away in FIG. 1B though the shield cover 30 covers the insulative housing 10 all the way from the right end of the cable connector to the left end. For the same purpose, FIG. 1 shows no coaxial cable though the cable connector comprises an assembly of coaxial cables 50 as described below.

Figure 3:
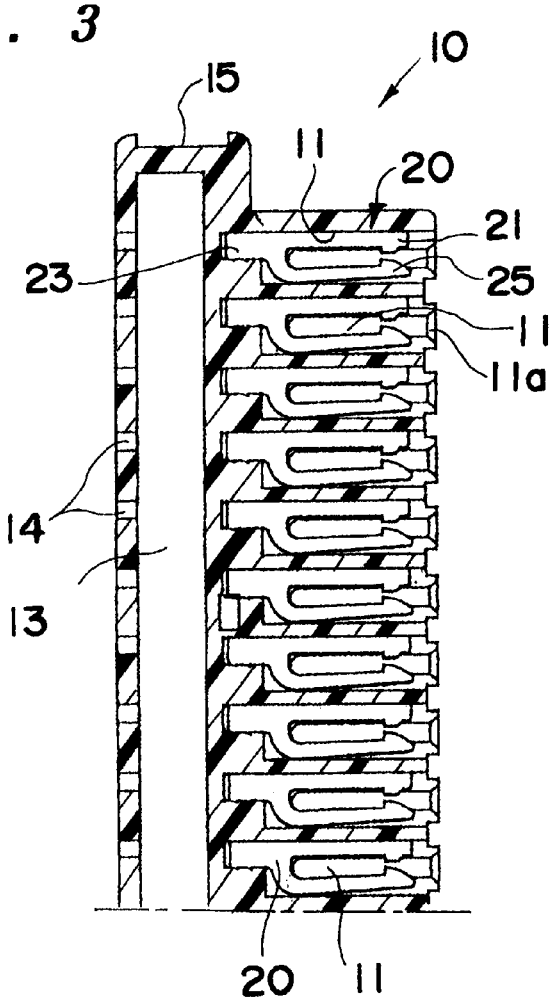
FIG. 3 is a sectional view of the cable connector, taken along line III—III in FIG. 1A.
Figure 10:
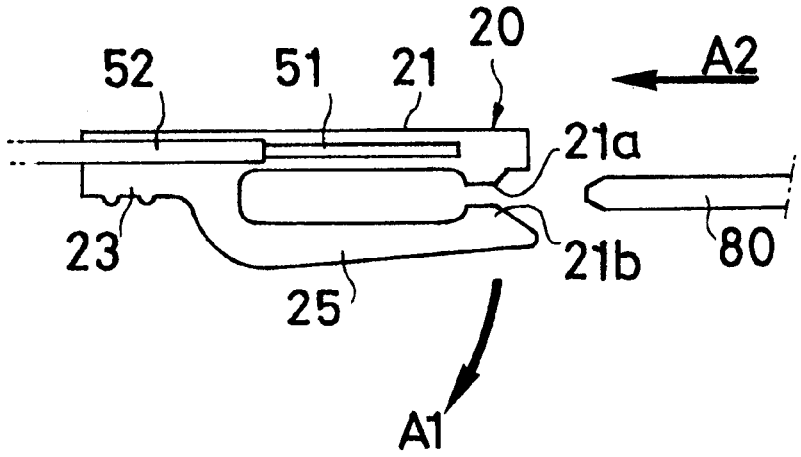
FIG. 10 is a plan view showing a female contact, which is a component of the cable connector, and a male contact, which is being engaged with this female contact.
Figure 11:
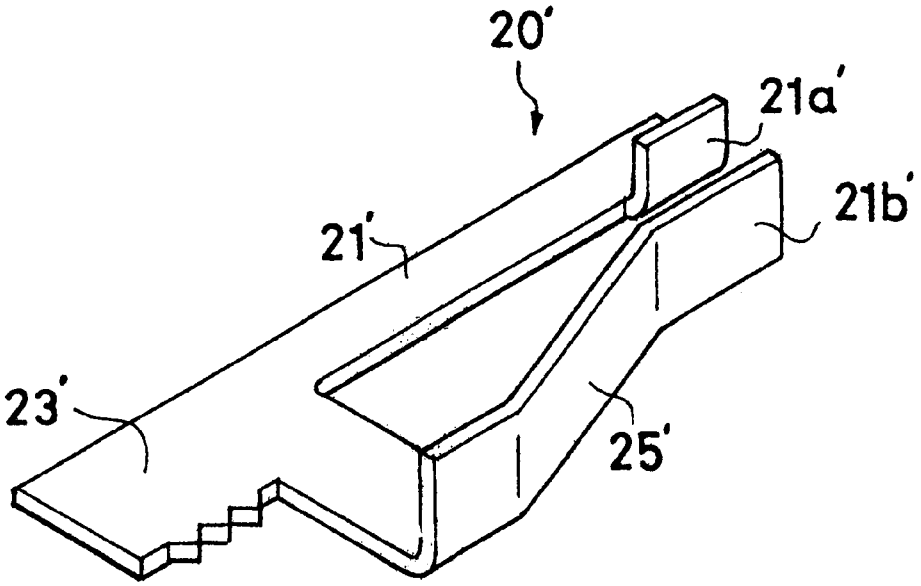
FIG. 11 is a perspective view of another female contact.

As shown in FIG. 3, which is a sectional view taken along line III—III in FIG. 1A, the insulative housing 10 includes a plurality of contact insertion slots 11, which are aligned in the direction of the width of the cable connector. Each contact insertion slot 11 has an insertion opening 11*a* which opens forward and through which a corresponding female contact 20 is fitted into and retained in the contact insertion slot 11. As shown in FIG. 3 and FIG. 10, each female contact 20 is formed of a metal plate into an approximate "Y" figure including a base portion 21, a press-fit portion 23 and a resilient arm portion 25. Thus, the female contact 20 looks like a tuning fork as a whole with the base portion 21 and the resilient arm portion 25 of the female contact 20 corresponding to the lateral prongs of a tuning fork and the press-fit portion 23 corresponding to the fixed portion of the tuning fork, respectively.

When the female contacts 20 are inserted through the insertion openings 11*a* and into the contact insertion slots 11 of the insulative housing 10, the base portions 21 and the press-fit portions 23 of the female contacts 20 are press-fit and fixed at the corresponding positions in the insulative housing 10 while the resilient arm portions 25 extend in the contact insertion slots 11 without restriction. Therefore, each resilient arm portion 25 can be deformed elastically in a corresponding contact insertion slot 11 in the direction indicated by arrow A1 in FIG. 10. It should be noted that the female contacts 20 are oriented horizontally on a plane one after another in the insulative housing 10 such that the plane of each female contact 20 extends in the direction of the width of the cable connector (this direction is hereinafter referred to as "width direction") while the thickness of each female contact 20 is in the direction of the height of the cable connector as shown in FIG. 3.

Figure 4:
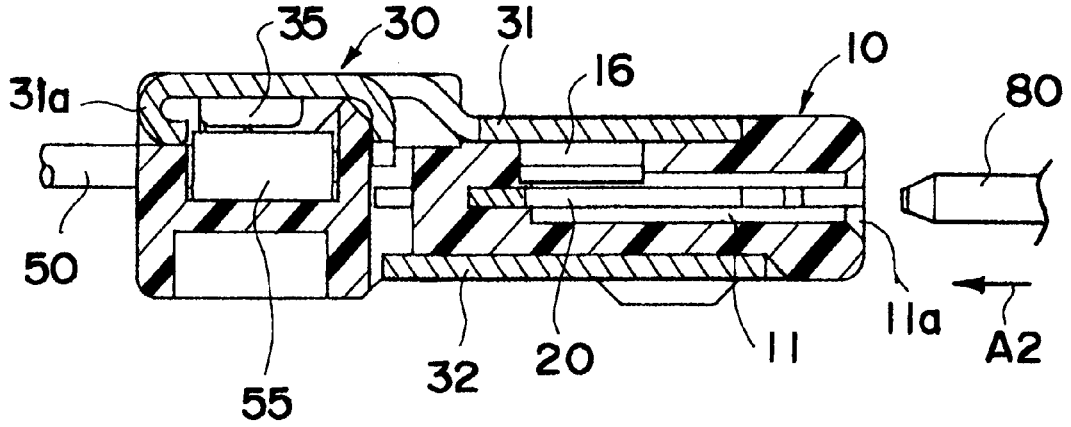
FIG. 4 is a sectional view of the cable connector, taken along line IV—IV in FIG. 1B.
Figure 5:
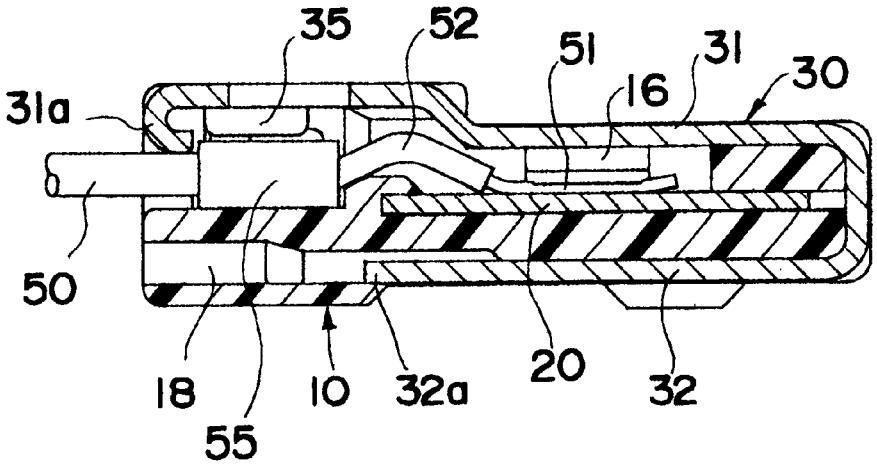
FIG. 5 is a sectional view of the cable connector, taken along line V—V in FIG. 1B.

In the insulative housing 10, the contact insertion slots 11 are open at the upper rear parts thereof, and a front central groove 16 is provided extending in the width direction at the rear side openings of the contact insertion slots 11 (refer to FIGS. 4 and 5). Also, behind the openings of the contact insertion slots 11 at the positions which corresponds to the base portions 21 of the female contacts 20 in the direction of the front and rear of the cable connector (hereinafter referred to as "axial direction"), a plurality of front cable support recesses 12 are provided aligned in the width direction and opening upward. Furthermore, behind these recesses 12, a rear central groove 13 is provided extending in the width direction and opening upward, and behind the rear central groove 13 at the positions which correspond to the front cable support recesses 12 in the axial direction, a plurality of rear cable support recesses 14 are provided aligned in the width direction and opening upward. Moreover, the insulative housing 10 is provided with cover fixing grooves 15 at the lateral rear portions thereof and with a plurality of bores 18 which pass through the housing in the axial direction as shown in the figures.

Figure 6A:
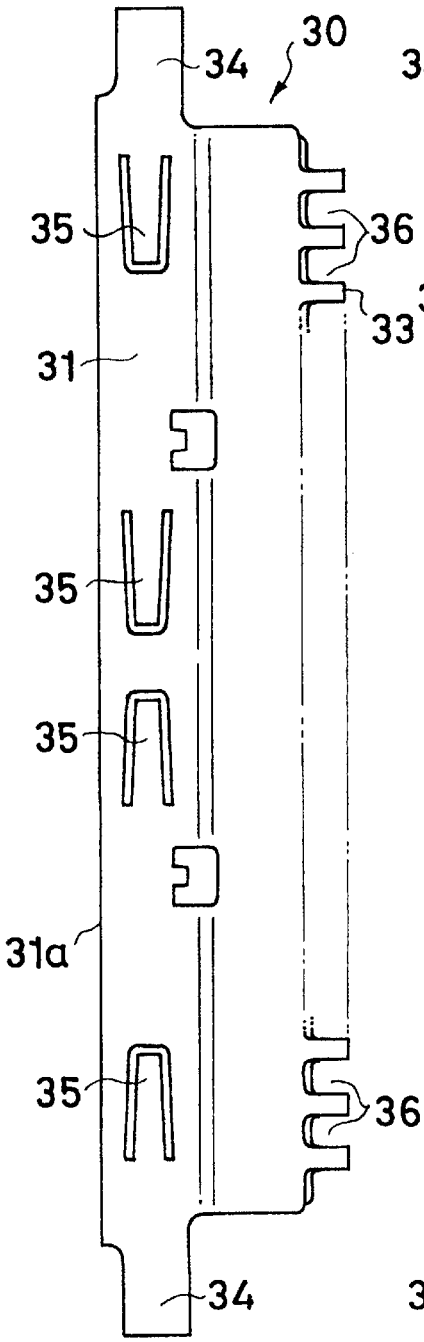
FIG. 6A, FIG. 6B, FIG. 6C, respectively show a plan view, a front view and a side view of a shield cover, which is a component of the cable connector.
Figure 6B:
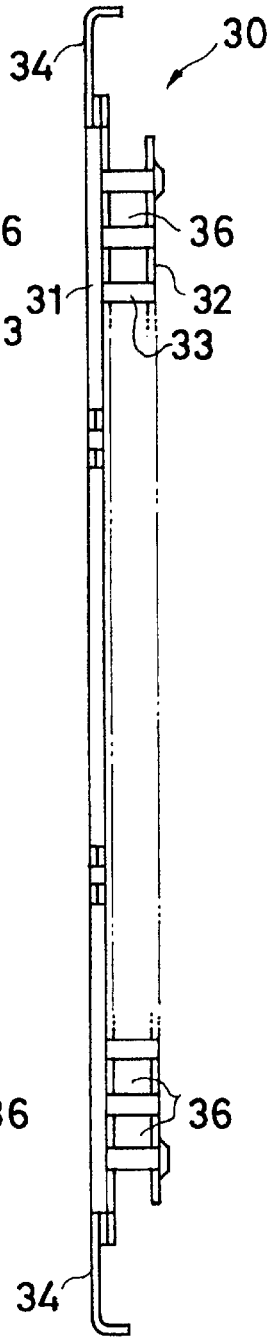
Figure 6C:
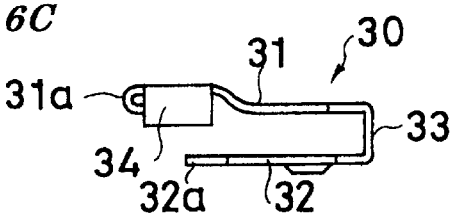

FIG. 6 shows the shield cover 30, which is to be mounted on the insulative housing 10. The shield cover 30 is formed of a metal plate and bent in a "U" figure as shown in FIG. 6C, and it comprises an upper covering surface 31, a lower covering surface 32 and a folded portion 33. The folded portion 33 includes a plurality of through holes 36, which are aligned in the width direction. The upper covering surface 31 includes four contact tabs 35, which are formed by incision and bent to slope downward toward the lower covering surface 32, and the right and left ends of the upper covering surface 31 extend laterally forming engaging arm portions 34. Moreover, the rear end of the upper covering surface 31 is folded inward providing a folded portion 31*a*, which improves the rigidity of the shield cover 30.

Figure 7B:
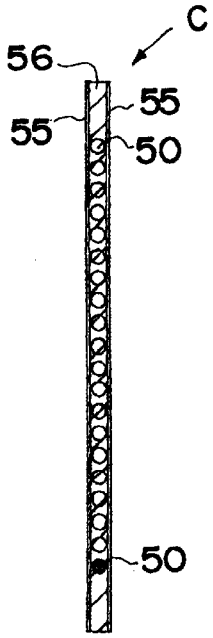
FIG. 7A, FIG. 7B, FIG. 7C, respectively, show a plan view, a front view and a side view of a cable assembly, which is a component of the cable connector.
Figure 7A:
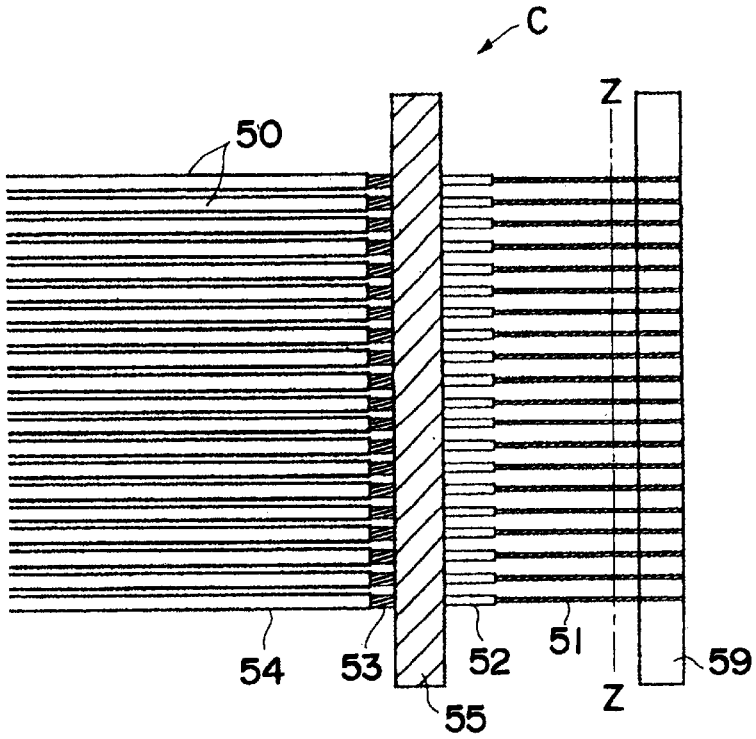
Figure 7C:
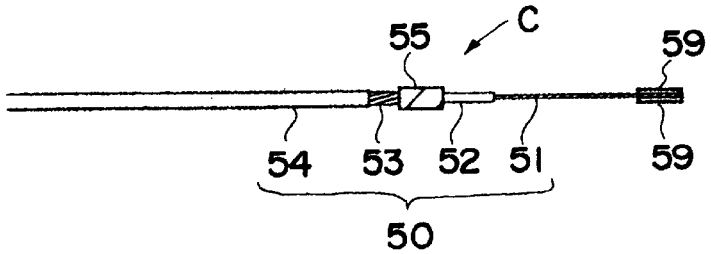

FIG. 7 shows a coaxial cable assembly C, whose coaxial cables are to be connected to the female contacts 20 fixed in the insulative housing 10, respectively. The cable assembly C comprises a plurality of coaxial cables 50, which are aligned on a plane and are sandwiched between a pair of upper and lower binding plates 55 as shown in the figure.

Figure 8A:
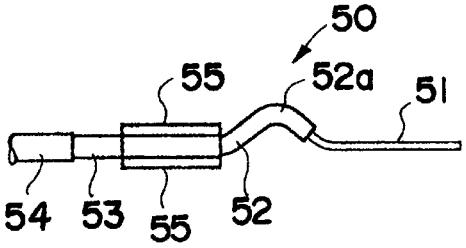
FIG. 8 shows a side view of the cable assembly and an enlarged sectional view of a coaxial cable.
Figure 8B:
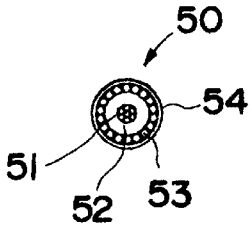

As shown in FIG. 8B, each of the coaxial cables 50 comprises an inner conductor (or core wire) 51, which is positioned centrally, an inner insulating layer 52, which surrounds the core wire 51, a braided outer conductor (or shielding layer) 53, which surrounds the inner insulating layer 52, and an outer insulating layer 54, which covers the shielding layer 53. The cable assembly C is assembled by stripping the respective layers of each coaxial cable 50 in a stair fashion, by aligning the coaxial cables 50 on a plane, by sandwiching the portions of the coaxial cables 50 where the shielding layers 53 are exposed with the binding plates 55 and by soldering them with a solder 56. Furthermore, the core wires 51, which are positioned at the front end of the cable assembly C, are coated with a solder. Moreover, the front ends of the core wires 51 are sandwiched with laminated films 59 to prevent deformation of the core wires 51 for the purpose of maintaining their relative positions intact. Before the cable assembly C is soldered to the plug connector, the front end portions of the core wires 51 are cut away at the position indicated by a chain line Z—Z in FIG. 7A, and the portions where the inner insulating layers 52 are exposed are bent in a U or V shape so that the coaxial cables are provided with slacks 52*a* as shown in FIG. 8A.

Now, in reference to FIGS. 4 and 5, a description is given of the assembly of the cable connector, whose components are described above. At first, the female contacts 20 are inserted through the insertion openings 11*a* of the insulative housing 10 and into the contact insertion slots 11 thereof. Upon the insertion, the female contacts 20 are aligned and fixed in the insulative housing 10 as described above. In this condition, the base portions 21 and the press-fit portions 23 of the female contacts 20 are fit and fixed at the corresponding positions in the insulative housing 10 while the resilient arm portions 25 can be deformed elastically in the corresponding contact insertion slots 11 in the direction indicated by arrow A1 in FIG. 10.

Figure 9:
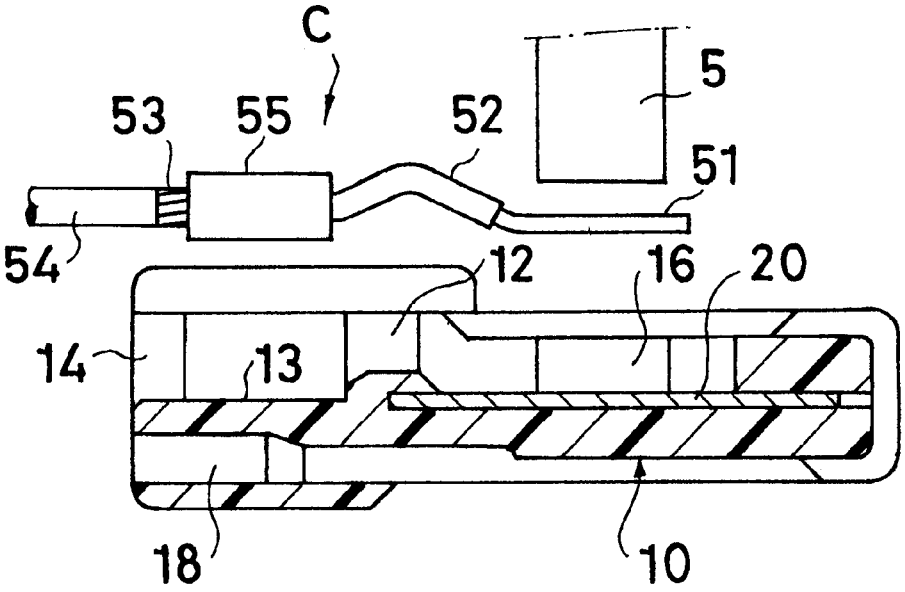
FIG. 9 is a sectional view to describe a process where the cable assembly is mounted in the cable connector.

On the insulative housing 10 in this condition, the cable assembly C is mounted downward from the above as shown in FIG. 9. In this mounting, the core wires 51 of the coaxial cables 50 are positioned on the base portions 21 of the female contacts 20, the inner insulating layers 52 of the coaxial cables 50 are positioned in the front cable support recesses 12 of the insulative housing 10, the binding plates 55 are positioned in the rear central groove 13 of the housing 10, and the exposed shielding layers 53 and outer insulating layers 54 of the coaxial cables 50 are positioned in the rear cable support recesses 14 of the housing 10 as shown in FIG. 10. Then, the heating chip 5 of a pulse heater is brought into the front central groove 16 of the insulative housing 10, and the heating chip 5 is pressed onto the core wires 51, which are positioned on the base portions 21 of the female contacts 20, to heat all the core wires 51 together. Because the core wires 51 are pre-coated with a solder, when they are heated by the heating chip 5, the solder melts and produces a soldered connection between each core wire 51 and the base portion 21 of a corresponding female contact 20.

Next, the shield cover 30 is mounted on the insulative housing 10. At first, the opening of the shield cover 30, whose cross section is a "U" figure, is oriented to face the front of the housing 10, and then the shield cover 30 is moved rearward to cover the housing 10. Here, as the shield cover 30 is provided with a plurality of protrusions 32*a* which extend rearward from the rear end of the lower covering surface 32 of the shield cover 30, when the shield cover 30 is moved to cover the insulative housing 10, these protrusions 32*a* enter the bores 18 of the housing 10 to fix the shield cover 30 to the housing 10 (refer to FIG. 5). As a result, the through holes 36 of the shield cover 30 meet the insertion openings 11*a* of the insulative housing 10, respectively. In this condition, each insertion opening 11*a* is open outward through a corresponding through hole 36.

In the condition where the shield cover 30 is mounted on the insulative housing 10, the upper covering surface 31 and lower covering surface 32 of the shield cover 30 cover the upper and lower surface of the housing 10, respectively, and the folded portion 33 of the shield cover 30 covers the front of the housing. In addition, the engaging arm portions 34 of the shield cover 30 are positioned in the cover fixing grooves 15 of the housing. As each of the engaging arm portions 34 is bent downward, the engaging arm portions 34 cover and fit the cover fixing grooves 15 of the housing 10 and fix the shield cover 30 on the housing 10. When the shield cover 30 is fixed on the insulative housing 10, the contact tabs 35 of the upper covering surface 31 of the shield cover 30 come into contact with the binding plates 55. As a result, the shielding layers 53 of the coaxial cables 50 are electrically connected to the shield cover 30.

When this cable connector is engaged with a matable connector, the shield cover 30 meets a shielding member of the matable connector, which member is electrically grounded. As a result, the shield cover 30 is electrically grounded and provides a shield effect which prevents any electrical noise from entering the cable connector and vice versa.

While the cable connector is being brought into engagement with the matable connector, the male contacts 80 of the matable connector are inserted through the insertion openings 11*a* of the insulative housing 10 into the contact insertion slots 11 of the housing 10 in the direction indicated by arrow A2 in FIGS. 4 and 10. By the insertion of the male contacts 80, the resilient arm portion 25 of each female contact 20 is deformed elastically in the direction indicated by arrow A1 in FIG. 10 to receive a corresponding male contact 80 in a space between the base portion 21 and the resilient arm portion 25 of the female contact 20. As a result, the male contacts 80 are bound and fixed between the base portions 21 and the resilient arm portions 25 of the female contacts 20, respectively, so the male contacts 80 are connected electrically with the female contacts 20. In this electrical connection, the male contacts 80 extend through the through holes 36 provided at the folded portion 33 of the shield cover 30, so this arrangement is effective in preventing crosstalk among the male contacts 80.

As described above, in this cable connector, each of the female contacts 20 is formed in a tuning fork figure, and the press-fit portion 23, which corresponds to the fixed portion of the tuning fork, is press-fit in the insulative housing 10. Furthermore, the base portion 21, which corresponds to one of the two prongs of the tuning fork, is fixed in the insulative housing 10. Therefore, the core wires 51 of the coaxial cables 50 are soldered securely on the base portions 21 and press-fit portions 23 of the female contacts 20. With this design, the length of the female contacts 20 in the axial direction is made relatively short, so the length of the cable connector in the axial direction is also reduced comparatively, thereby making the cable connector compact in design.

In the design of the above described female contact 20, the press-fit portion 23 is provided behind the base portion 21. This press-fit portion 23 may be shortened even further, or it may be eliminated completely, and only the portion which connects the base portion 21 and the resilient arm portion 25 may be left and press-fit in the insulative housing 10. In this way, the length of the female contact can be made even shorter.

In the above invention, the core wires 51 of the coaxial cables 50 are soldered on the base portions 21 of the female contacts 20. However, the base portions 21 may be designed such that the core wires 51 may be crimped with the base portions 21, respectively. Furthermore, the base portions 21 may be designed for a pressure welding, and the core wires 51 which are still covered with the inner insulating layers 52 may be pressed onto the base portions 21 in the pressure welding to achieve the electrical connections of the core wires and the base portions.

Figure 12:
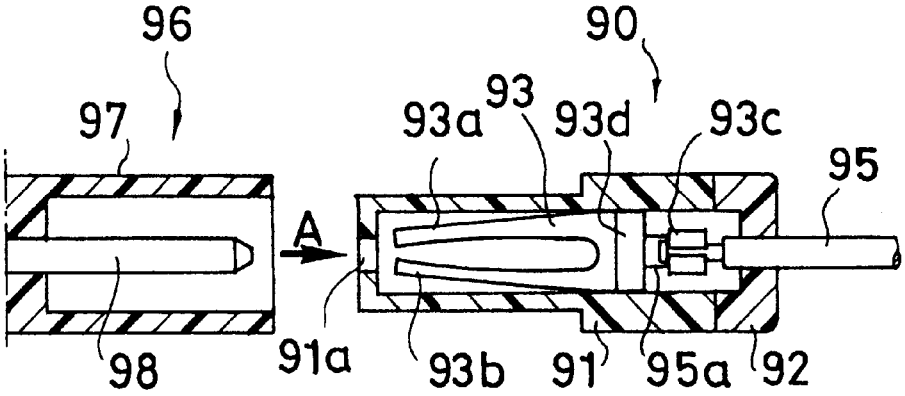
Fig. 12 PRIOR ART
FIG. 12 is a perspective view of a prior-art cable connector.

FIG. 12 shows another embodiment of female contact, which is formed by punching and bending a metal plate. This female contact 20', which can be used in the cable connector, comprises a base portion 21', a press-fit portion 23' and a resilient arm portion 25'. In this case, the front end of the base portion 21' is bent to form a contact portion 21*a'*, and the resilient arm portion 25' is bent vertically and provided at the front end thereof with a contact portion 21*b'*, which faces the contact portion 21*a'*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 11-233217 filed on Aug. 19, 1999, which is incorporated herein by reference.

What is claimed is:

1. An electrical cable connector comprising a plurality of contacts and a plurality of cables, said contacts being aligned and retained in a row extending in a right and left direction in an electrically Insulative housing, and each of said cables being connected at one end thereof to a corresponding contact in said insulative housing and extending out of said insulative housing;

wherein:

each of said contacts comprises a base portion and a resilient arm portion, said base portion being fixed in said insulative housing, and said resilient arm portion being formed in one body with said base portion and extending along said base portion with a predetermined distance therebetween;

said one end of said cable is connected directly to said base portion by mounting directly on said base portion; and when said cable connector is engaged with a matable connector, each of said contacts receives and holds a corresponding contact portion of said matable connector in a space between said base portion and said resilient arm portion, so that the contacts of said cable connector and said matable connector are connected electrically.

2. The electrical cable connector set forth in claim 1, wherein:

said one end of each cable is soldered, crimped or pressure-welded on said base portion of a corresponding contact.

3. The electrical cable connector set forth in claim 1, wherein:

said contact is formed in a figure of tuning fork with a short leg portion or without any leg portion, one prong constituting said base portion and another prong constituting said resilient arm portion.

4. The electrical cable connector set forth in claim 1, wherein: said contact is formed of a metal plate in an approximate "Y" figure like a tuning fork, comprising said base portion, said resilient arm portion and a press-fit portion, said base portion and said resilient arm portion corresponding to lateral prongs of the tuning fork and said press-fit portion corresponding to a fixed portion of the tuning fork, said one end of said cable being soldered on a face of said base portion.

5. An electrical cable connector comprising a plurality of contacts and a plurality of cables, said contacts being aligned and retained in a row extending in a right and left direction in an electrically insulative housing, and each of said cables being connected at one end thereof to a corresponding contact in said insulative housing and extending out of said insulative housing; wherein: each of said contacts comprises a base portion and a resilient arm portion, said base portion being fixed in said insulative housing, and said resilient arm portion being formed in one body with said base portion and extending alongside said base portion with a predetermined distance therebetween; said one end of said cable is connected to said base portion; and when said cable connector is engaged with a matable connector, each of said contacts receives and holds a corresponding contact portion of said matable connector in a space between said base portion and said resilient arm portion, so that the contacts of said cable connector and said matable connector are connected electrically, wherein:

said contact is formed of a metal plate in an approximate "Y" figure like a tuning fork, comprising said base portion, said resilient arm portion and a press-fit portion, said base portion and said resilient arm portion corresponding to lateral prongs of the tuning fork and said press-fit portion corresponding to a fixed portion of the tuning fork and, said insulative housing is provided with a plurality of contact insertion slots, into which said contacts are inserted, respectively, to constitute said cable connector; and when said contacts are pressed into and positioned in said contact insertion slots, said base portion and said press-fit portion of each contact are fit into and fixed in a corresponding contact insertion slot of said insulative housing while said resilient arm portion is suspended and deformable elastically in the contact insertion slot.

6. The electrical cable connector set forth in claim 4 wherein:

said insulative housing is provided with a plurality of contact insertion slots, into which said contacts are inserted, respectively, to constitute said cable connector; and said contact insertion slots are aligned in a row in a direction of a width of said cable connector, such that when said contacts are positioned in said contact insertion slots, said contacts are aligned in the width direction on a plane.

7. The electrical cable connector set forth in claim 1, wherein: said one end of each cable extends along said base portion at said location.

8. An electrical cable connector comprising a plurality of contacts and a plurality of cable core wires, said contacts being aligned and retained in a row extending in a right and left direction in an electrically insulative housing, and each of said core wires being connected at one end thereof to a corresponding contact in said insulative housing and extending out of said insulative housing;

wherein:

each of said contacts has a unitary plate-form body comprising a base portion and a resilient arm portion with respective coplanar faces and adjacent edges, said base portion being fixed in said insulative housing; and said resilient arm portion extending along said base portion with respective edges in opposed, spaced-apart relation defining between them a space for receiving a corresponding contact portion of a matable connector said one end of said core wires being connected directly to said base portion by soldering directly on said major face of said base portion at a location opposite said resilient arm portion; and when said cable connector is engaged with said matable connector, each of said contacts receives and holds said corresponding contact portion of said matable connector, so that the contacts of said cable connector and said matable connector are connected electrically.

9. The connector of claim 8 wherein each said one end of said core wires extends along said base portion.

* * * * *